US005733153A

United States Patent [19]

Takahashi et al.

[11] Patent Number: 5,733,153

[45] Date of Patent: Mar. 31, 1998

[54] SAFETY CONNECTOR

[75] Inventors: Noboru Takahashi; Masanori Kachi, both of Nagoya, Japan

[73] Assignee: Mitsubishi Denki Kabushiki Kaisha, Tokyo, Japan

[21] Appl. No.: 779,124

[22] Filed: Jan. 6, 1997

Related U.S. Application Data

[62] Division of Ser. No. 504,663, Jul. 20, 1995.

[30] Foreign Application Priority Data

Jul. 28, 1994 [JP] Japan ..... 6-176394

[51] Int. Cl.[6] ..... H01R 4/30

[52] U.S. Cl. ..... 439/801; 439/910

[58] Field of Search ..... 439/801, 910, 439/912, 79, 80

[56] References Cited

U.S. PATENT DOCUMENTS

| | | | |
|---|---|---|---|
| 4,221,455 | 9/1980 | Cairns et al. | 439/355 |
| 4,526,431 | 7/1985 | Kasukawa | 439/723 |
| 4,674,814 | 6/1987 | Hoshino et al. | 439/701 |
| 5,071,362 | 12/1991 | Martens et al. | 439/188 |
| 5,403,204 | 4/1995 | Chishima et al. | 439/513 |
| 5,482,470 | 1/1996 | Atsumi et al. | 439/246 |

FOREIGN PATENT DOCUMENTS

| | | |
|---|---|---|
| 2508721 | 12/1982 | France . |
| 3922072 | 1/1991 | Germany . |
| 4224618 | 1/1994 | Germany . |
| 59-33686 | 3/1984 | Japan . |
| 61-133987 | 8/1986 | Japan . |
| 61-138174 | 8/1986 | Japan . |
| 63-45983 | 3/1988 | Japan . |
| 63-164172 | 10/1988 | Japan . |
| 3-8283 | 1/1991 | Japan . |
| 3-39280 | 4/1991 | Japan . |
| 5-82206 | 4/1993 | Japan . |

*Primary Examiner*—Neil Abrams
*Assistant Examiner*—T C Patel
*Attorney, Agent, or Firm*—Sughrue, Mion, Zinn, Macpeak & Seas, PLLC

[57] ABSTRACT

A connector for connecting a cable including a socket housing having a terminals screw for connecting the cable, a substrate pin for electric connection with the terminal screw, and a pin header on which the socket housing can be mounted to cover the screw. With this connector, no dedicated tool or dedicated machine is required when connecting a cable to the socket housing, which insures improved workability as well as the safety of the connector and realizes size reduction.

18 Claims, 10 Drawing Sheets

SAFETY CONNECTOR

This is a divisional of application Ser. No. 08/504,663 filed Jul. 20, 1995.

FIELD OF THE INVENTION

The present invention relates to a connector used for making a connection between an apparatus and a cable, and more particularly to a connector with improved workability as well as safety in connection.

BACKGROUND OF THE INVENTION

There has been proposed a terminal board having the configuration shown in FIG. 16. (See Japanese Utility Model Laid-Open Publication No. 194172/1988. The conventional connector includes a baseboard 37, a set screw hole 38 provided on the baseboard 37, a terminal section 40 connected to the baseboard 37, a baseboard fixing screw 39 for fixing the baseboard 37 and terminal section 40 with the set screw hole 38, an insulating cover 42 for covering the terminal section 40, and an insulating cover hole 41 provided in the terminal section 40 to fix the insulating cover 42 to the terminal section 40.

With the configuration described above, the terminal section 40 is fixed at a specified position on the baseboard 37 by tightening the baseboard setting screw 39 into the set screw hole 38. A cable is connected to each terminal in the terminal section 40. Also, the insulating cover 42 is fixed by making use of the insulating cover hole 4! in the open section of the terminal section 40.

FIGS. 17A–17C are explanatory views illustrating an example of conventional connector, of which FIG. 17A is a perspective view illustrating a socket housing. As shown in these figures, a plurality of terminal holes 51 are provided in the socket housing 50. FIG. 17B is a perspective view illustrating a state where an end portion of the cable 52 from which the insulation has been stripped is fixed to the terminal 53 (indicated by the solid line). The state indicted by the alternate long and short dash line shows the original form of the terminal. To fix the cable to the terminal, the terminal is crimped in the direction indicated by the arrow. FIG. 17C is a cross-sectional view illustrating the state where the terminal 53, once fixed to the cable 52, is mounted on the socket housing 50.

For further information concerning similar connectors, reference may be made to Japanese Utility Laid-Open Publication No. 39280/1991 disclosing a "Pressure Connector", Japanese Utility Model Laid-Open Publication No. 45983/1988 disclosing a "Terminal Connector for a Bus Line", Japanese Utility Model Laid-Open Publication No. 164172/1988 disclosing a "Connector Type Terminal Board", Japanese Utility Model No. 33686/1984 disclosing a "Connector with Resistor", Japanese Utility Model Laid-Open Publication No. 138174/1986 disclosing a "Connector Housing", Japanese Patent Laid-Open Publication No. 82206/1993 disclosing a "Connector Device", and Japanese Utility Model Laid-Open Publication No. 133987/1986 disclosing a "Connector for a Circuit Board".

In the conventional connectors as described above, however, there are several problems, as described below.

Firstly, to connect a cable to a socket housing, a step of fixing the cable to a terminal and a step of inserting the terminal with the cable fixed thereto into the socket housing are required. For this, a dedicated tool or a dedicated machine is required for fixing the cable to the terminal.

Second, in the conventional terminal board, it is easy to open or close the insulating cover. Thus, since the cover can easily be opened by mistake, safety is not insured. Moreover, to tighten the terminal screw, it is required to remove the insulating cover, which means that the workability is quite poor.

Third, in a computer-type bus transmission system using the conventional connector or terminal board described above, such as for making a connection between a driver IC and a receiver IC mounted on a substrate inside the transmission device, the transmission path will be opened if the connector is dislodged. Also, addition if connection is to be made between a driver IC and a receiver IC outside the system, external wiring is required, which also means poor workability.

Fourth, when a plurality of devices are connected to each other with a cable, if wiring connection is carried out with such a connector or a terminal board, all the cables for each device are connected via the connector or the terminal board, and hence the wiring connection between connecters or terminal boards for each device and cable can be made only after installation of the cable. Moreover, if multiple connectors or different types of terminal board are used to overcome the problems described above, the number of parts is increased, which in turn results in a cost increase of the device and prevents size reduction of the device.

Fifth, in the conventional connector or terminal board described above, if it is required to connect a terminal resistor for a transmission path, the resistor must be mounted outside the connector or the terminal board or installed inside a transmission device. Thus, the workability is again poor and the cost of the transmission device disadvantageously increased.

Sixth, when switching a transmission system with a transmission device in which both a transmission system based on a bus system and one based on a loop system are available, it is necessary to connect or disconnect external wiring to and from the conventional connector or terminal board, which again means poor workability.

SUMMARY OF THE INVENTION

It is an object of the present invention to provide a connector which eliminates the necessity for a dedicated tool or a dedicated machine when connecting a cable to a socket housing, which improves the workability in connecting as well as the safety of the connector, and also which prevents an increase the device cost and allows size reduction of the device.

In a connector according to the present invention, a terminal section is provided in the socket housing, so that a dedicated tool is not required for connecting a cable to the socket housing and the cable can be connected to the socket housing with a screwdriver, and furthermore a terminal screw head is housed inside the pin header by inserting the socket housing into the pin header, so that it is not required to mount an insulating cover.

Also in a connector according to the present invention, a hole into which a screwdriver or a test pin can be inserted is provided in a pin header of the connector, so that the terminal screw can be tightened without removing the socket housing from the pin header, and a cable continuity check can be carried out by inserting a test pin even after the socket housing is inserted onto the pin header.

In a connector according to the present invention, contact elements for contacts opposing each other inside a socket housing with connectors arranged in two arrays are provided, so that the two opposing connectors can contact each other electrically, which eliminates the necessity of separate wiring on a substrate inside the associated device and external wiring for the connector section.

In a connector according to the present invention, the socket housing with connectors arranged in two arrays can be modified to a two-socket housing in which each housing is provided for a corresponding array of connectors, and two units of socket housing can be engaged with each other for connection. In addition, it is not necessary to provide two separate connectors or two separate terminal boards for each device. Furthermore, when cable connection is carried out between a plurality of devices, only two cables are connected to each device (other than the one located at the final terminal of each cable), and each of the two cables is connected to each socket housing. The two units of socket housing, each with a cable connected thereto, are engaged with each other for making connection and then inserted into a two-stage pin header, so that cable connection between devices can be achieved prior to installation.

In a connector according to the present invention, terminal resistors for a bus transmission system may be provided in a socket housing. Thus, when a transmission cable is connected to one of the socket housings of a connector of a device located at a final stage in a bus transmission system, a resistor to terminate the bus line can be easily connected thereto, so that it is not necessary to provide a separate terminal resistor for each device.

In a connector according to the present invention, a separator comprising a nonconductive flat plate for preventing contact between contact elements can be mounted on the pin header, so that it is not necessary to connect or disconnect a transmission line to and from external wiring when switching between a bus system transmission and a loop system transmission is executed.

In a connector according to the present invention, the separator may incorporate a terminal resistor for a transmission line, whereby a resistor to terminate the transmission line can be connected merely by mounting the separator, so that it is not necessary to provide a separate terminal resistor in each device.

In a connector according to the present invention, a portion of a flat plate can be inserted so that connection can be established at required locations among a plurality of contact elements, external wiring is not required, and only continuity between contacts in the socket housing is required.

In a connector according to the present invention, furthermore, a separator can be mounted after a socket housing is inserted into a pin header, so that the mounting state of the separator can be checked without removing the socket housing from the pin header, and in addition a disconnection check for the cable can be carried out by inserting a separator into each of the interconnected devices.

Other objects and features of this invention will become understood from the following description with reference to the accompanying drawings.

DESCRIPTION OF THE PREFERRED EMBODIMENTS

Figure 1:
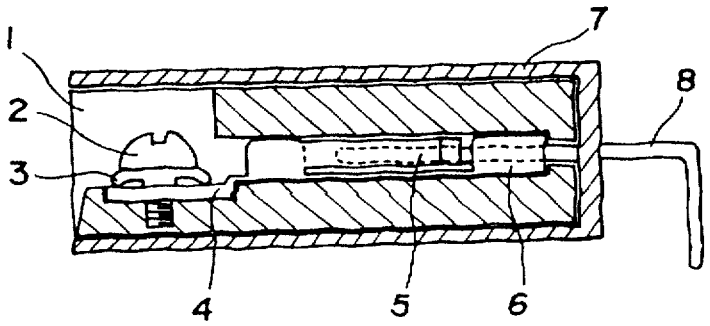
FIG. 1 is a cross-sectional view illustrating the configuration of a connector according to Embodiment 1 of the invention.
Figure 2:
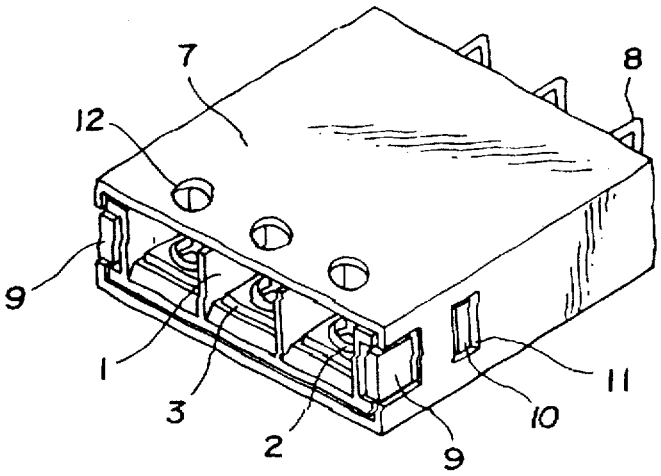
FIG. 2 is a perspective view illustrating the configuration of a connector according to Embodiments 1 and 2 of the invention.
Figure 3:
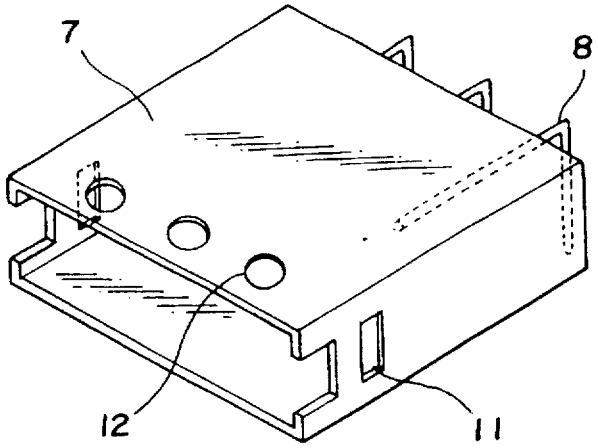
FIG. 3 is a perspective view illustrating the configuration of the connector according to Embodiments 1 and 2 of the invention.
Figure 4:
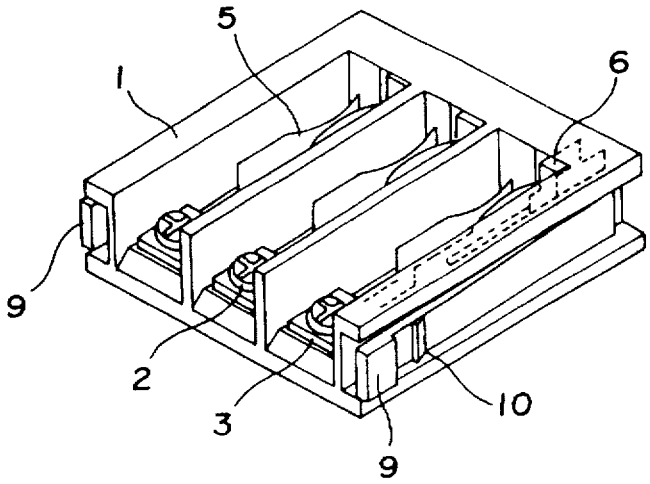
FIG. 4 is a perspective view illustrating the configuration of the connector according to Embodiments 1 and 2 of the invention.

A detailed description will now be provided of preferred embodiments of connectors according to the present invention. First, a description is given for Embodiment 1. FIG. 1 is a cross-sectional view illustrating a connector according to Embodiment 1, and FIGS. 2 to 4 are perspective views each illustrating the connector according to Embodiment 1.

The connector according to Embodiment 1 is basically composed of a socket housing 1 and a pin header 7. The socket housing 1 includes a plurality of contacts 4 each having a pin contact 5 contacting a substrate pin 8 for making electric connection thereto and a contact fixing section 6 for preventing displacement of the contacts 4 in right, left, and upward directions, an angular washer 3 set above the contact 4 and holding a cable with the contact 4 therebetween, a terminal screw 2 pressing down the cable with the angular washer 3, and a lock tab 9 having a lock piece 10 for preventing the socket housing 1 from being pulled off the pin header 7.

The pin header 7 has a substrate pin 8 for making electric connection between a circuit board and the contact 4 in the socket housing 1, and an engagement hole 11 in which the lock piece 10 of the socket housing 1 is hooked to prevent disengagement.

With the configuration as described, to connect a cable, the terminal screw 2 in the socket housing 1 is loosened, an end of a cable with the insulation removed is inserted between the angular washer 3 and the contact 4, and the cable is connected to the socket housing 1 by tightening the terminal screw 2.

Then, the socket housing 1 is inserted into the pin header 7 so that the lock piece 10 is engaged in the engagement hole 11 to prevent disengagement of the socket housing 1. At this point, the terminal screw 2 in the socket housing 1 and the angular washer 3 are housed within the pin header 7. For this reason, contact by an external object with the terminal screw 2 in the socket housing or with the angular washer 3 is prevented, which insures improved safety.

Next a description will be provided of Embodiment 2. FIG. 2, FIG. 3 and FIG. 4 are perspective views each illustrating Embodiment 2. In these figures, the connector according to Embodiment 2 has a terminal screw hole 12 in which a screwdriver can be inserted when the socket housing 1 is housed in the pin header 7 of the connector according to Embodiment 1 above.

With the configuration described above, a continuity check for a cable inserted between the connectors can be carried out by inserting a screwdriver into the terminal screw hole 12 and tightening the terminal screw 2 in a state where the socket housing with a cable connected thereto has been inserted into the pin header 7, and by inserting a test pin from the terminal screw hole 12. This also insures improved workability.

Figure 5:
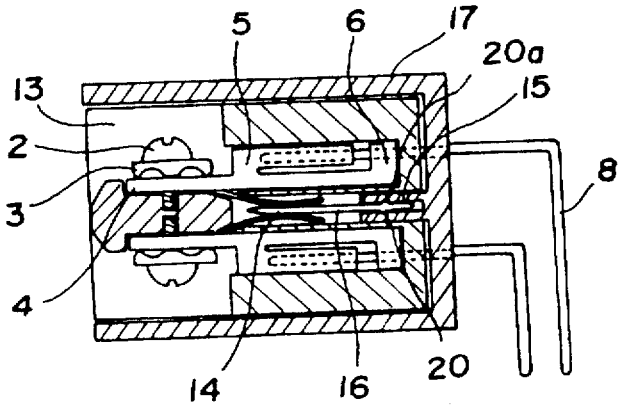
FIG. 5 is a cross-sectional view illustrating the configuration of a connector according to Embodiments 3 and 6 of the invention.
Figure 6:
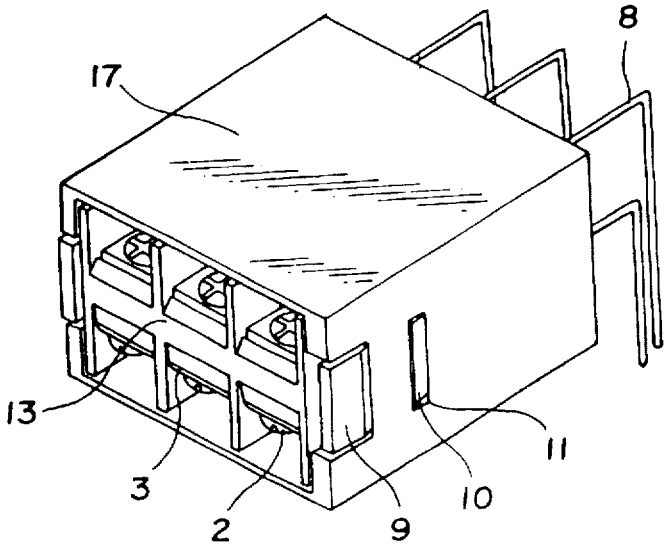
FIG. 6 is a perspective view illustrating the configuration of the connector according to Embodiment 3 of the invention.
Figure 7:
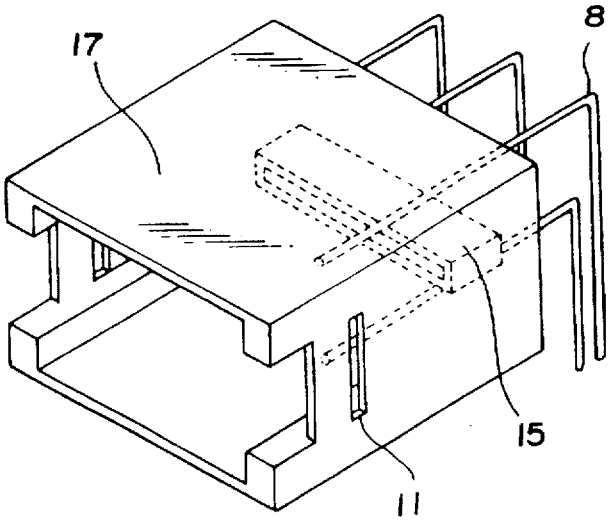
FIG. 7 is a cross-sectional view illustrating the configuration of the connector according to Embodiments 3 and 8 of the invention.

Next a description will be given of Embodiment 3. FIG. 5 is a cross-sectional view illustrating the connector according to Embodiment 3, and FIG. 6 and FIG. 7 are perspective views each illustrating the same. Furthermore, FIG. 14 is an explanatory view illustrating an example of transmission based on a bus system in which the connector according to Embodiment 3 is used.

The connector according to Embodiment 3 includes a two-stage socket housing 13 and a two-stage pin header 17. The two-stage socket housing 13 has a plurality of contacts 4 each having a pin contact 5 contacting the substrate pin 8 for making electric connection and a contact fixing section 6 for preventing the contact 4 from being displaced in right, left, or upward directions. Also, a contact element 14, an angular washer 3 holding a cable with the contact 4 therebetween and a terminal screw 2 for pressing down the cable with the angular washer 3 are, located so that each opposes the other and corresponding opposing contacts 4 can electrically contact each other. A lock lever 9 has a lock piece 10 for preventing the two-stage socket housing 13 from being pulled off the two-stage pin header 17.

The two-stage pin header 17 includes a circuit board, substrate pins 8 for making electric connection with the contact 4 in the two-stage socket housing 13, and an engagement hole 1i in which the lock piece 10 of the two-stage socket housing 13 is hooked for preventing disengagement of the two-stage socket housing 13.

Figure 14:
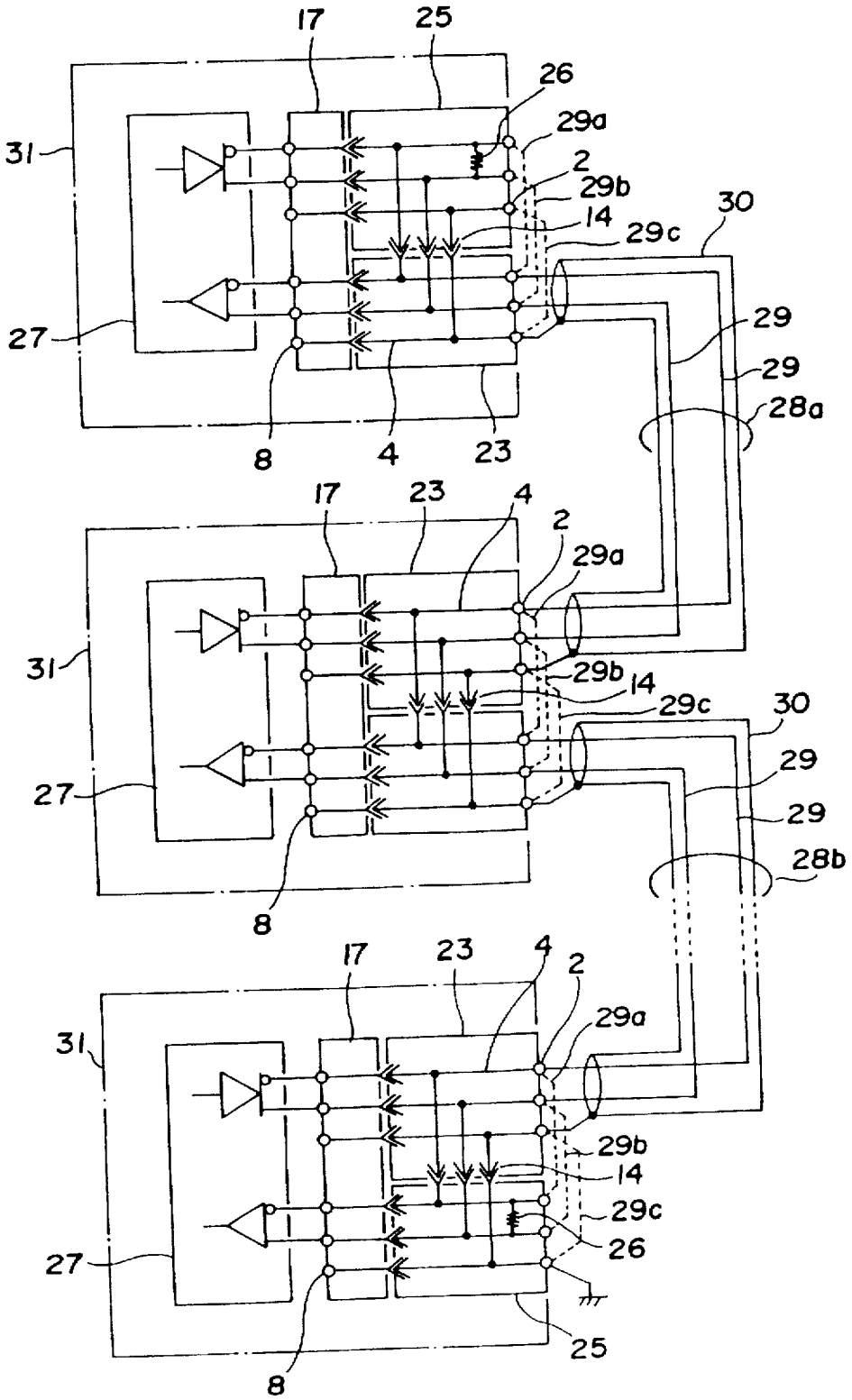
FIG. 14 is an explanatory view illustrating the configuration for transmission based on a bus system utilizing the connector of Embodiment 4.

With the configuration described above, opposing contacts 4 can establish electrical continuity through contact elements 14, so that external wiring **29*a*, 29*b*, 29*c* shown in FIG. 14** is not required, which further insures improved workability.

Figure 9:
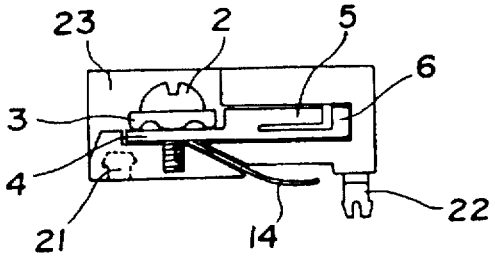
FIG. 9 is a cross-sectional view illustrating the configuration of a connector according to Embodiment 4 of the invention.
Figure 10:
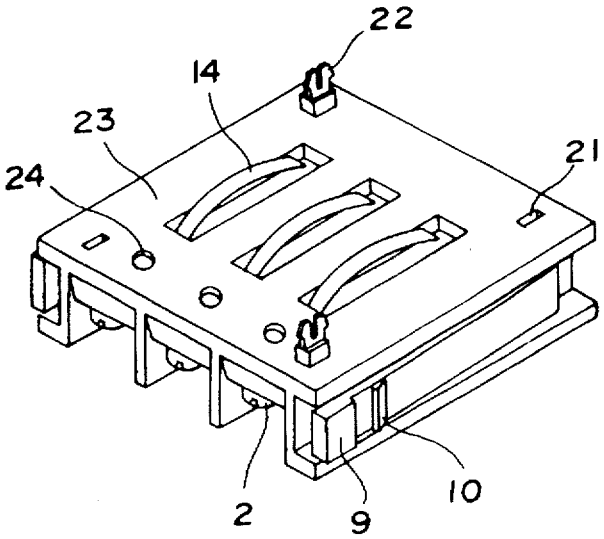
FIG. 10 is a perspective view illustrating the configuration of the connector according to Embodiment 4 of the invention.
Figure 11:
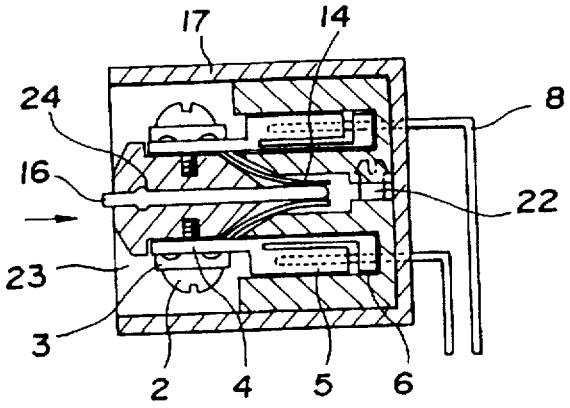
FIG. 11 is a cross-sectional view illustrating the configuration of a connector according to Embodiments 4 and 9 of the invention.
Figure 13:
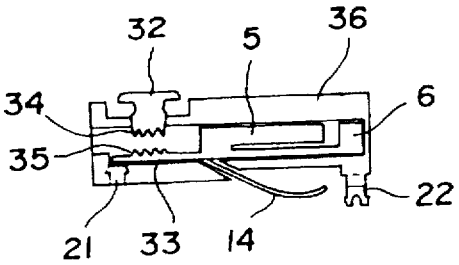
FIG. 13 is a cross-sectional view illustrating an example of modification of the connector according to Embodiment 5 of the invention.

Next a description will be given of Embodiment 4. FIG. 9 and FIG. 11 are cross-sectional views each illustrating a connector according to Embodiment and FIG. 10 is a perspective view illustrating the same. FIG. 13 is an example of a modification of the configuration shown in FIG. 9, and in addition FIG. 14 is an explanatory view illustrating the configuration for transmission based on a bus system in which the connector according to Embodiment 4 is used.

The connector according to Embodiment 4 employs a separate socket housing 23 and a two-stage pin header 17. The separate socket housing 23 has an engagement pin 22 for engaging and connecting two units of the separate socket housing 23 to the socket housing 1 according to Embodiment 1 described above in a state where the two units of the separate socket housing face each other. Art engagement pin insertion hole 21 is where the engagement pin 22 is inserted, and a contact element 14 is provided for enabling an electric contact between the contacts 4 opposing each other when the two units of the separate socket housing 23 are engaged and connected to each other.

With the configuration described above, electric continuity between opposing contacts 4 can be established through the contact element 14, so that it is not necessary to provide the external wiring **29*a*, 29*b*, 29*c* shown in FIG. 14. Furthermore, as two units of the socket housing 23 are engaged and connected to both edges of the transmission cables 28*a*, 28*b*, inserted into the two-stage pin header 17, even if the transmission cables 29*a*, 28*b* are connected to the separate socket housing 23, the transmission cables 28*a*, 28*b* are not integrated into one cable through the separate socket housing 23 until the separate socket housing 23** is engaged and connected thereto, which yet further insures improved workability.

The connector shown in FIG. 13 is a modification of the separate socket housing 23 shown in FIG. 9 (separate socket housing 36). As shown in FIG. 13, a pushbutton 32 having a pushbutton concave-and-convex section 34 and a contact 33 having a contact concave-and-convex section 33 are provided in place of the terminal screw 2. When the push button 32 is pressed down, the push button concave-and-convex section 34 and the contact concave-and-convex section 35 are engaged with each other, and thus the cable is connected thereto.

Figure 12:
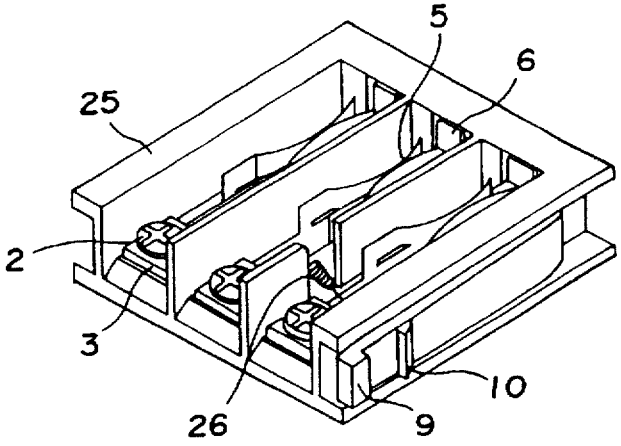
FIG. 12 is a perspective view illustrating the configuration of a connector according to Embodiment 5 of the invention.

Next, a description is provided for Embodiment 5. FIG. 12 is a perspective view illustrating a connector according to Embodiment 5, while FIG. 14 is an explanatory view illustrating a configuration for transmission based on a bus system in which the connector according to Embodiment 5 is used.

The connector according to Embodiment 5 has a socket housing 25 in which terminal resistors 26 for respective transmission lines are connected by means of soldering to the contacts 4 arrayed in parallel in the separate socket housing 23 in the same manner as in Embodiment 4.

With the configuration described above, terminal processing for a transmission path can be carried out by engaging and connecting the socket housing 25 incorporating the terminal resistor 26 therein to the terminal end of the transmission cable shown in FIG. 14, so that connection of external wiring is not required, again insuring improved workability.

Figure 8:
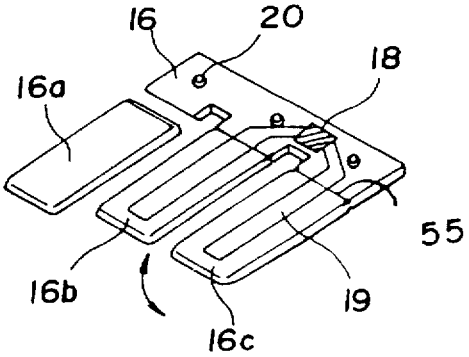
FIG. 8 is a perspective view illustrating the configuration of a connector according to Embodiments 7 and 8 of the invention.

Next, a description is given of Embodiment 6 FIG. 5 is a cross-sectional view illustrating the configuration of a connector according to Embodiment 6, and FIGS. 7 and 8 are perspective views thereof. Further, FIG. 15 is an explanatory view illustrating the configuration for transmission based on a loop system in which the connector according to Embodiment 6 is employed.

The connector according to Embodiment 6 employs a two-stage socket housing 13, a two-stage pin header 17, and a separator 16. The two-stage pin header 17 includes a separator mounting section 15 disposed between substrate pins 8 extending parallel to each other, and a concave section 20*a* engaging a convex section 20 for fixing the separator 16 to the separator mounting section 15. The separator 16, which is made of an electrically non-conductive material, has a plurality of flat plates 16*a*, 16*b*, 16*c* at positions preventing contact between the contact elements 14 of the two-stage socket housing 13 when the separator is inserted into the separator mounting section 15, and also has a convex section 20 for fixing the separator so that it cannot be dislodged at the position where the convex section 20 engages the concave section 20*a* inside the separator mounting section 15.

Figure 15:
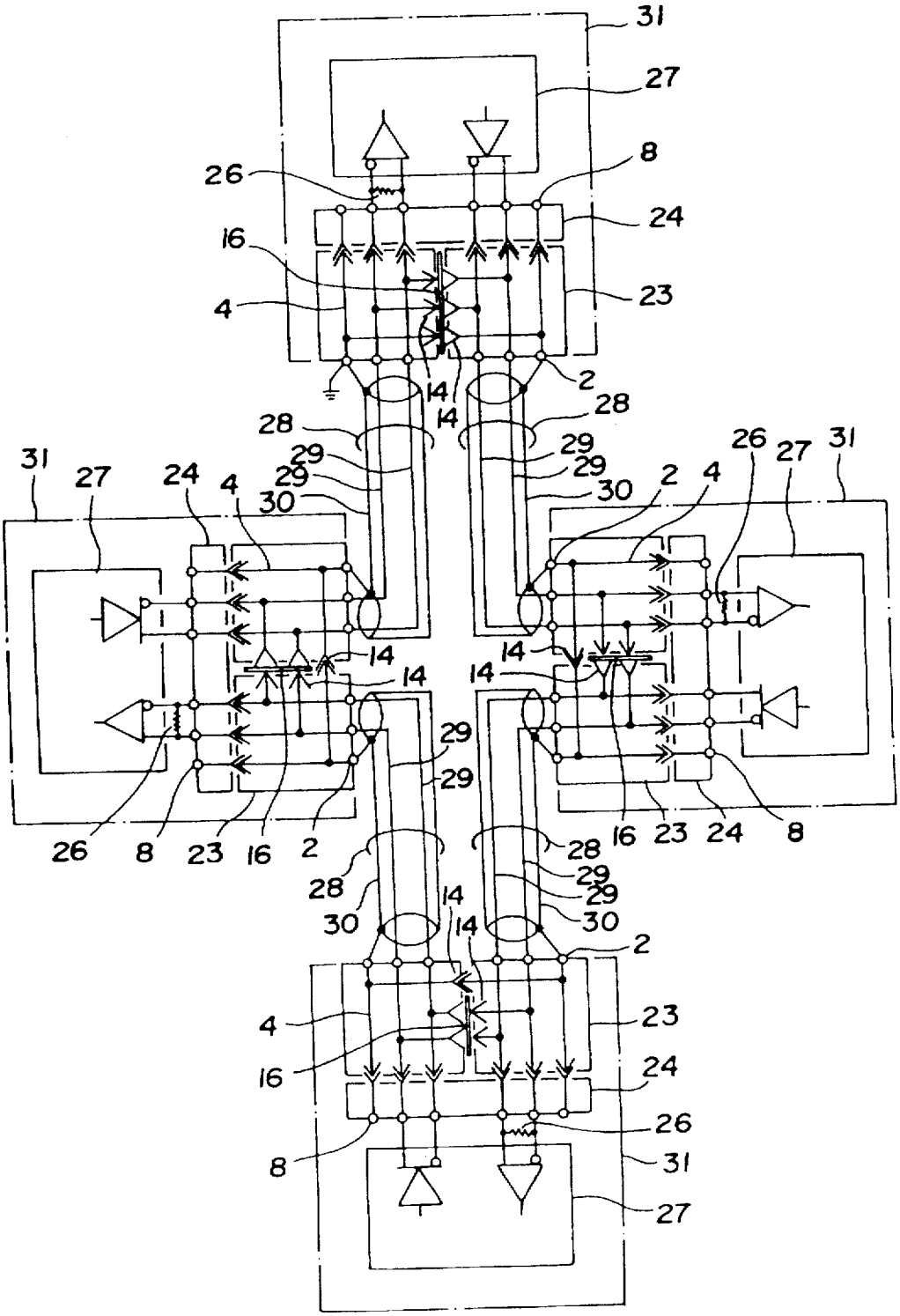
FIG. 15 is an explanatory view illustrating the configuration for transmission based on a loop system utilizing the connector of Embodiment 6.
Figure 16:
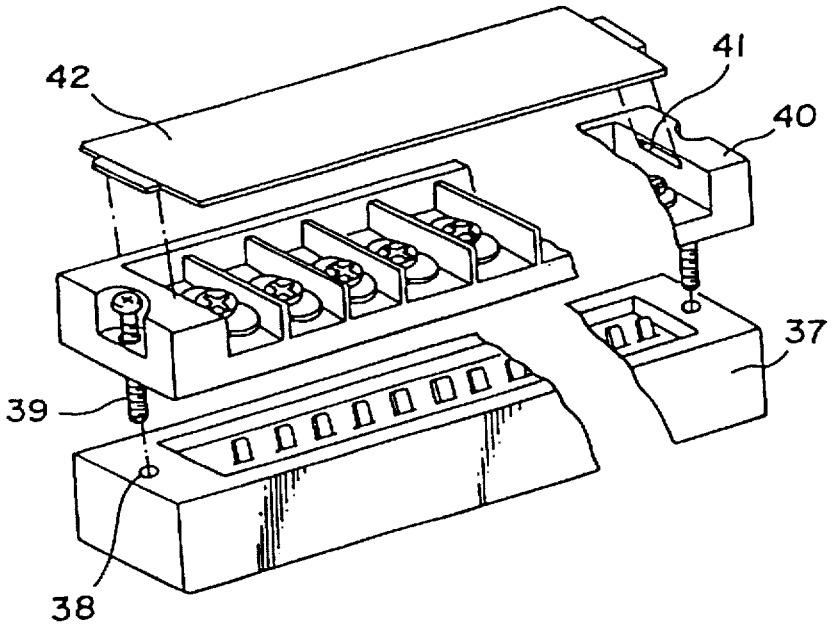
FIG. 16 PRIOR ART
FIG. 16 is a developed perspective view illustrating the configuration of a conventional terminal board.
Figure 17A:
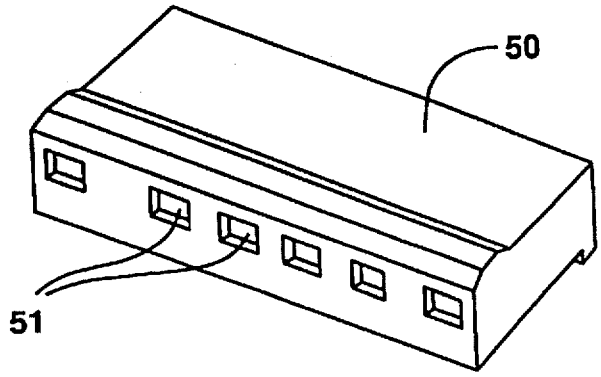
FIG.17A PRIOR ART
FIGS. 17A, 17B and 17C are explanatory views illustrating the configuration of a conventional connector.
Figure 17B:
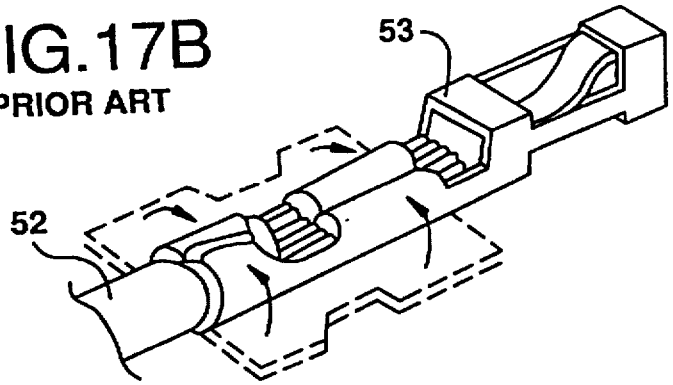
FIG.17B PRIOR ART
Figure 17C:
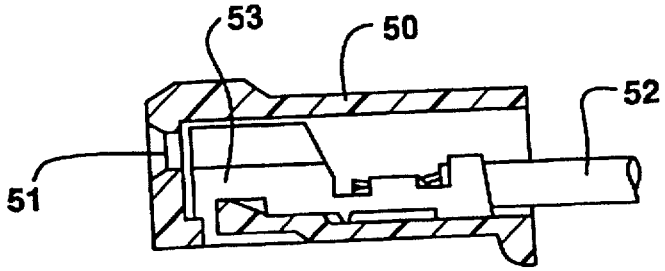
FIG.17C PRIOR ART

With the configuration described above, when the two-stage socket housing 13 is inserted into the two-stage pin header 17 by inserting the separator 16 into the two-stage pin header 17, the contact elements 14 of the two-stage socket housing 13 are separated from each other by the separator 16, so that transmission based on the loop system shown in FIG. 15 is enabled. When the separator 16 is not mounted, transmission based on the bus system shown in FIG. 14 is enabled.

In case of transmission based on the loop system, when the two-stage socket housing 13 is pulled off from the two-stage pin header 17, the separator 16 remains inside the two-stage pin header 17 so that the contact elements 14 contact each other. For this reason it becomes possible to separate a transmitter 31 without disconnecting the transmission path. Furthermore, when the two-stage socket housing 13 is connected at a position where the transmitter 31 is to be connected, an additional transmitter 31 can be installed.

Next a description is provided for Embodiment 7. FIG. 8 is a perspective view illustrating the configuration of a separator for a connector according to Embodiment 7, while FIG. 15 is an explanatory view illustrating a configuration for transmission based on a loop system in which the separator 16 for a connecter according to Embodiment 7 is employed. The separator 16 according to Embodiment 7 includes in a separator according to Embodiment 6, a thick-film resistor 18 and a conductive pad 19.

With the configuration described above, the thick-film resistor 18 and the conductive pad 19 are incorporated into the separator 16 so that the contact elements 14 in the two-stage socket housing 13 contact the conductive pad 19. Terminal processing for a transmission line is thus readily implemented since it is not necessary to provide the terminal resistor 26 shown in FIG. 15 inside the transmitter 31.

Next a description is given of Embodiment 8. FIG. 8 is a perspective view illustrating the configuration of a separator for the connector according to Embodiment 8, and FIG. 15 is an explanatory view illustrating a configuration for transmission based on a loop system in which the separator for a connector 15 according to Embodiment 8 is employed. The separator 16 according to Embodiment 8 includes, in addition to the separator according to Embodiment 6, a disconnecting section 55 with a thin connecting section (thin compared with other pares of the separator 16) for the flat plates 16*a*, 16*b*, 16*c* so that the flat plates 16*a*, 16*b*, 16*c* can be separated independently.

With the configuration described above, one of the flat plates 16*a*, 16*b*, 16*c* can be separated by making use of the disconnecting section 55 when the flat plates 16*a*, 16*b*, 16*c* are bent in a direction indicated by an arrow, such that the contact elements 14 can be contacted at any position with each other. As a result, as shown in FIG. 15, when a shield line 30 is grounded with only the final terminal of a transmission cable 28, connection between shield lines 30 can be established by separating the flat plates of the separator 16 in each transmitter (other than the transmitter 31) to be grounded, so that external wiring is not required.

Next a description is provided for Embodiment 9. FIG. 11 is a cross-sectional view illustrating the configuration of Embodiment 9. The connector according to Embodiment 9 has a separate socket housing 23, a two-stage pin header 17, and a separator 16. A separate socket housing 23 has a concave section 24 for fixing a separator in the separate socket housing 23 for the connector according to Embodiment 4 above.

With this configuration, two units of a separate socket housing 23 engaged and connected to each other are inserted into the two-stage pin header 17, and then the separator 16 is inserted into the assembly in the direction indicated by an arrow. Thus, it becomes possible to interrupt connection between the contact elements 14 by engaging and connecting the convex section 20 for fixing the separator in the concave section 24. For this reason, disconnection of a cable between devices can be carried out after a plurality of devices are connected with the cable merely by inserting a separator.

As described above, with the connector according to the present invention, a dedicated tool is not required when connecting a cable to a socket housing, which insures improved workability in cabling. Furthermore, since the terminal pin section is covered by the pin header, safety is improved.

With the connector according to the present invention, the terminal screws can be tightened after the socket housing has been inserted into the pin header, which in turn insures improved workability.

Further, to connect various devices via a bus line, it is not necessary to connect a driver IC to a receiver IC in each device with external wiring, and in addition transmission faults due to a mistake in wiring can be prevented.

With the connector according to the present invention, connection of cables for interconnecting various devices can be carried out prior to installation of the cables, the work efficiency for wiring can be improved, and in addition, as it is not necessary to provide two units of a connector or terminal board for each device, the overall cost can be reduced.

Still further, with the connector according to the present invention, it is not necessary to provide a separate terminating resistor or a switch for each device, again reducing costs.

Moreover, it is possible to effect either transmission based on a bus system or transmission based on a loop system with the same transmitter, still further reducing costs. Furthermore, in case of transmission based on a loop system, a transmitter can be exchanged with another one or another transmitter can be added to the system without interrupting transmission, which improves the reliability of the transmission system.

Yet further, contact elements can be electrically connected or disconnected according to the necessity, so that external wiring is not required.

With the connector according to the present invention, it is possible to check the mounting state of a separator without removing the socket housing, and furthermore a continuity check between devices can be executed even after the cable is installed between devices.

Although the invention has been described with respect to specific embodiments for a complete and clear disclosure, the appended claims are not to be thus limited but are to be construed as embodying all modifications and alternative constructions that may occur to one skilled in the art which fairly fall within the basic teachings herein set forth.

What is claimed is:

1. A connecter for a conductor, comprising:

a socket housing comprising a terminal section having a terminal to which the conductor is connected and a pin contact connected to said terminal, wherein said terminal section has an open top portion; and a pin header comprising a substrate pin, said socket housing being receivable within said pin header in such a manner that said pin header covers said terminal section and said pin contact is electrically connected with said substrate pin, wherein said pin header has a through-hole formed therein at a position such that the open top portion of said terminal section aligns with said through hole when said socket housing is received in said pin header.

2. A connector as claimed in claim 1, wherein said terminal comprises a screw adapted to connect to the conductor, said screw aligning with said through-hole when said socket housing is received in said pin header.

3. A connector as claimed in claim 1, wherein said socket housing comprises a plurality of terminal sections having open top portions, and said pin header comprises a plurality of through holes therein at positions such that each of the open top portions of said terminal sections aligns with one of said through holes when said socket housing is received in said pin header.

4. A connector as claimed in claim 3, wherein each of said terminal sections comprises a terminal having a screw adapted to connect to a conductor, said screw aligning with a corresponding one of said through-holes when said socket housing is received in said pin header.

5. A connector as claimed in claim 1, wherein said socket housing further comprises at least one locking mechanism which locks said socket housing to said pin header when said socket housing is received in said pin header.

6. A connector as claimed in claim 5, wherein said locking mechanism comprises a lock piece and said pin header has an engagement hole therein which receives said lock piece when said socket housing is received in said pin header.

7. A connector as claimed in claim 6, wherein said locking mechanism further comprises a resilient member on which said lock piece is disposed, said resilient member urging said lock piece into said engagement hole when said socket housing is received in said pin header.

8. A connector as claimed in claim 7, wherein said locking mechanism further comprises a lock tab which is disposed on said resilient member and is depressible to move said resilient member in a direction to remove said lock piece from said engagement hole.

9. A connector as claimed in claim 8, wherein said socket housing comprises two of said locking mechanisms.

10. A connecter for a conductor, comprising:

a socket housing comprising a terminal section having a terminal, wherein said terminal section has an open top portion; and a pin header, said socket housing being receivable within said pin header in such a manner that said pin header covers said terminal section, wherein said pin header has at least one through-hole formed therein at a position such that the open top portion of said terminal section aligns with said through hole when said socket housing is received in said pin header.

11. A connector as claimed in claim 10, wherein said terminal comprises a screw adapted to connect to the conductor, said screw aligning with said through-hole when said socket housing is received in said pin header.

12. A connector as claimed in claim 10, wherein said socket housing comprises a plurality of terminal sections having open top portions, and said pin header comprises a plurality of through holes therein at positions such that each of the open top portions of said terminal sections aligns with one of said through holes when said socket housing is received in said pin header.

13. A connector as claimed in claim 12, wherein each of said terminal sections comprises a terminal having a screw adapted to connect to a corresponding conductor, said screw aligning with a corresponding one of said through-holes when said socket housing is received in said pin header.

14. A connector as claimed in claim 10, wherein said socket housing further comprises at least one locking mechanism which locks said socket housing to said pin header when said socket housing is received in said pin header.

15. A connector as claimed in claim 14, wherein said locking mechanism comprises a lock piece and said pin header has an engagement hole therein which receives said lock piece when said socket housing is received in said pin header.

16. A connector as claimed in claim 15, wherein said locking mechanism further comprises a resilient member on which said lock piece is disposed, said resilient member urging said lock piece into said engagement hole when said socket housing is received in said pin header.

17. A connector as claimed in claim 16, wherein said locking mechanism further comprises a lock tab which is disposed on said resilient member and is depressible to move said resilient member in a direction to remove said lock piece from said engagement hole.

18. A connector as claimed in claim 17, wherein said socket housing comprises two of said locking mechanisms.

* * * * *